US005540557A

United States Patent [19]

Carson

[11] Patent Number: 5,540,557

[45] Date of Patent: Jul. 30, 1996

[54] VACUUM PUMP FOR CONTAINERS

[76] Inventor: James A. Carson, 27621 Hacienda Blvd. #325-B, Bonita Springs, Fla. 33923

[21] Appl. No.: 438,246

[22] Filed: May 10, 1995

Related U.S. Application Data

[63] Continuation-in-part of Ser. No. 199,642, Feb. 22, 1994, Pat. No. 5,450,963.

[51] Int. Cl.[6] ..... F04B 37/10; B65B 31/04

[52] U.S. Cl. ..... 417/53; 417/313; 417/437; 417/555.1; 53/510; 92/117 A; 92/240; 141/65

[58] Field of Search ..... 417/313, 437, 417/454, 547, 555.1, 566, 567, 53; 92/145, 117 A, 240; 53/510; 141/65

[56] References Cited

U.S. PATENT DOCUMENTS

| | | | |
|---|---|---|---|
| 1,615 | 5/1840 | Evens . | |
| 48,826 | 7/1865 | Mills . | |
| 416,034 | 11/1889 | Grove . | |
| 526,175 | 9/1894 | Barbour | 417/555.1 |
| 1,528,559 | 3/1925 | Miller . | |
| 1,973,103 | 9/1934 | Replogle . | |
| 2,106,775 | 2/1938 | Trask'. | |
| 2,246,868 | 6/1941 | Trask . | |
| 2,622,792 | 3/1946 | Ramclow . | |
| 2,782,876 | 2/1957 | Crabtree . | |
| 2,783,715 | 3/1957 | Kraus | 417/437 |
| 2,913,293 | 10/1957 | Dibley et al. . | |
| 4,287,819 | 9/1981 | Emerit | 417/437 |
| 4,583,925 | 4/1986 | Hawkins | 417/555.1 |
| 4,627,796 | 12/1986 | Moore | 417/550 |
| 4,975,028 | 12/1990 | Schultz | 417/553 |
| 5,332,095 | 7/1994 | Wu . | |

*Primary Examiner*—Richard E. Gluck
*Assistant Examiner*—Roland G. McAndrews, Jr.
*Attorney, Agent, or Firm*—Quarles & Brady

[57] ABSTRACT

A vacuum pump for removing air from containers includes a pump housing in the form of a conduit with an open end and a closed end. A piston in the form of a conduit, open at each end, is slidably mounted within the housing, and has an inside end within the housing and an outside end protruding from the housing. The outside end of the piston is adapted to fit over a valve secured to the container. A piston ring is provided substantially at the inside end of the piston. The piston ring is adapted to mate tightly with an interior surface of the housing, such that movement of the housing away from the outside end of the piston will draw a vacuum through the valve to remove air from the container through the valve. A system and method for removing air from containers is also disclosed.

24 Claims, 4 Drawing Sheets

VACUUM PUMP FOR CONTAINERS

CROSS-REFERENCE TO RELATED APPLICATION

This is a continuation-in-part of U.S. patent application Ser. No. 08/199,642, filed Feb. 22, 1994, now U.S. Pat. No. 5,450,963.

FIELD OF THE INVENTION

This invention relates generally to vacuum pumps, and more particularly to vacuum pumps for removing air from containers.

BACKGROUND OF INVENTION

Sealed storage containers are used to store goods and perishable items, and typically include either specialized removable closures, heat-sealable closures or high pressure airtight self-sealable closures. Removal of air from the container is usually not accomplished after sealing. Devices have been available to remove air from open bags and then seal the bags with heat or high pressure sealing devices. In some instances, these devices remove air from the bags, but generally are unavailable to perform this function after the bag has been sealed.

Applicant's prior application, Ser. No. 08/199,642, filed Feb. 22, 1994, describes a device for removing air from a flexible container after the sealing of the container. According to this invention, upper and lower units of a valve housing are attached to a flexible wall area of the container, and the central core of each unit is aligned with an opening in the flexible wall, which opening is punctured by a suitable device. After the storage container has been filled, it is sealed and the valve is attached to an air removal pump to remove enclosed air and create a low atmosphere storage environment within the container. After the container has been reused, it may be resealed and the enclosed air can again be removed by a pump.

The removal of air from containers is often desirable but is not always a practical process. Pumps useful for removing air through the valve are relatively expensive to manufacture and sometimes difficult to use. It would therefore be desirable to provide a device which would facilitate the removal of air from containers, and particularly containers of differing construction such as flexible wall containers, rigid containers, and containers with removable closures.

SUMMARY OF THE INVENTION

It is an object of the invention to provide a vacuum pump which will facilitate the removal of air from containers.

It is another object of the invention to provide a vacuum pump which can be used with a variety of different container constructions.

It is still another object of the invention to provide a vacuum pump which will be easy to use.

It is still another object of the invention to provide a vacuum pump which is easily manufactured.

These and other objects are accomplished by a vacuum pump for containers having an outer pump housing and a piston, the piston being in the form of a conduit slidably mounted within the housing. An upper portion of the piston includes a piston ring portion which seals the space between the piston and the housing. A cap portion is provided over the housing to prevent the escape of air.

Upward movement of the housing relative to the piston draws a vacuum as the volume between the top of the piston and the top of the housing expands and the piston ring prevents the entry of outside air. Downward movement of the housing forces air in the volume past the piston ring, which is constructed so as to prevent only the entry of air into the volume and to permit the escape of air.

A perforator is preferably provided in connection with the vacuum pump to permit the puncturing of the wall of a flexible wall container. The perforator is preferably provided on the housing. The perforator permits an opening to be created in the flexible wall for the insertion of a valve without the use of a separate perforation device. In a preferred embodiment, the perforating portion of the vacuum pump is an elongated member which extends along the length of the housing and is attached at one end to the housing and is unattached at the opposite end to allow the flexible wall material to be thrust onto the unattached end so as to perforate the flexible wall.

BRIEF DESCRIPTION OF THE DRAWINGS

There are shown in the drawings embodiments which are presently preferred, it being understood, however, that the invention is not limited to the precise arrangements and instrumentalities shown, wherein.

DETAILED DESCRIPTION OF THE PREFERRED EMBODIMENTS

Figure 1:
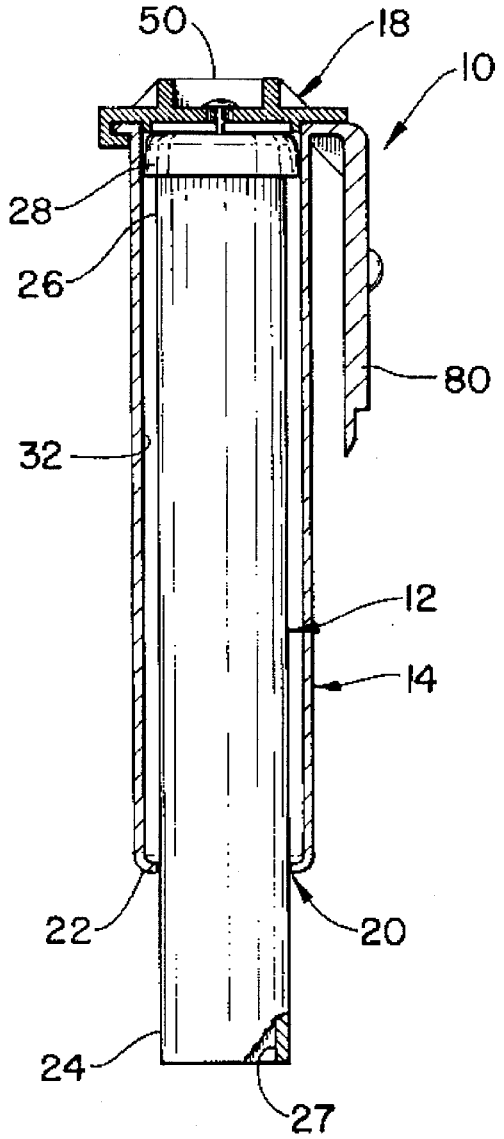
FIG. 1 is a partial cross-section of a vacuum pump according to the invention.

A vacuum pump 10 according to the invention is shown in FIG. 1. The vacuum pump 10 comprises a piston 12 and an outer pump housing portion 14. The piston 12 and housing 14 are elongated members with hollow cores. The piston 12 is slidably mounted within the housing 14. The housing and piston are preferably tubular in shape, although other shapes are possible.

The housing 14 has a closed end 18 and an open end 20. The piston 12 is slidably mounted within the housing 14 and extends out of the open end 20 of the housing 14. An inwardly extending flange 22 can be provided at the open end 20 of the housing 14 so as to position the piston 12 and provide for a more stable sliding action within the housing 14.

Figure 11:
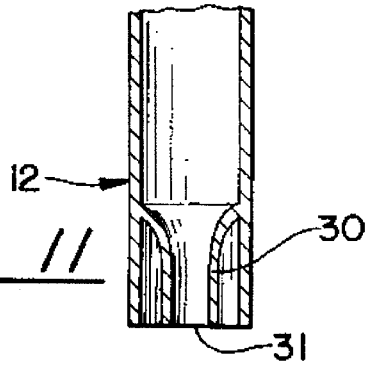
FIG. 11 is a sectional view of a vacuum pump having an alternative end construction.

The piston 12 is open at each end. An outside end 24 extends outwardly from the housing 14. An inside end 26 is positioned within the housing 14. The end 24 can have an outward taper 27 toward the opening to facilitate forming a tight seal with the outside perimeter of a valve housing. Alternatively, as shown in FIG. 11, an interior flange 30 that is generally conical in shape with a central opening 31 can be provided. The interior flange 30 can be fitted into the opening of a valve to seal against an inside surface of the valve housing.

A top portion of the piston 12 includes a sealing piston ring 28. The sealing piston ring 28 is preferably molded together with the piston 12. The piston ring 28 can be formed as a thin flange which extends angularly outwardly in the direction of the outside end 24 of the piston 12. The piston ring 28 is preferably formed from a thinner portion of material than is the piston 12, so as to make the piston ring 28 at least partially elastic.

The piston ring 28 has an unflexed outside peripheral dimension that is larger than the inside diameter of the housing 14. The sealing piston ring 28 is flexed in the direction of the open end 20 of the housing 14 during the construction process. This will create an outward spring action between the piston ring 28 and an interior wall 32 of the housing 14 to form a seal between the piston 12 and housing 14.

Figure 2:
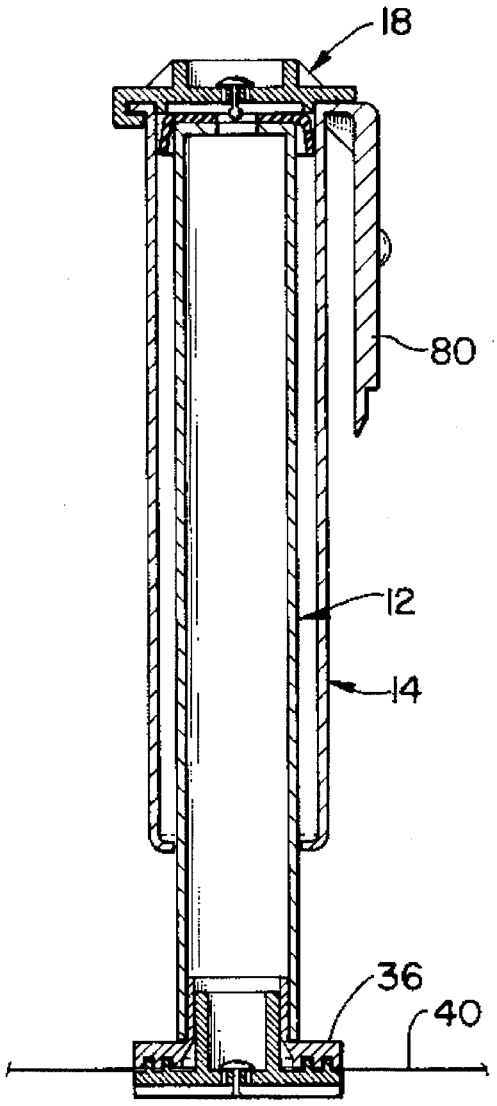
FIG. 2 is a cross-section of a valve positioned in the wall of a flexible wall container, and a vacuum pump according to the invention attached to the valve and in a first mode of operation.

The vacuum pump 10 is applied to a valve in a container, such as the valve 36 extending through an opening in the flexible wall 40 shown in FIG. 2. The valve 36 is adapted for use in flexible wall containers and includes a valve housing 38 which is aligned with the opening in the flexible wall, and structure to form an airtight seal with the surrounding portions of the flexible wall 40 such that the valve forms a substantially hermetic seal to the outside air. The valve 36 is preferably a one way check valve which permits the withdrawal of air from within the container, but prevents air from re-entering the container from the outside.

The valve 36 can have an inwardly tapered perimeter portion 43 which corresponds to the outward taper 27 of the end 24. For example, the end 24 can have a thickness of 1/16", and can taper over a length of about 1/8" to a thickness of about 1/32". The valve perimeter 43 can have a taper of similar slope and dimension, but which is oppositely directed such that the two surfaces will wedge together when they are pressed together. The tapered surfaces will cause the pump 10 to seat tightly against the perimeter of the valve 36 when the end 24 of the pump is pressed against the valve 36.

The pump 10 is positioned over the valve housing 38 of the valve. The open end 24 of the piston 12 is placed over and held against the valve housing so as to tightly seal with the valve housing 38 of the valve. The pump housing 14 is grasped and drawn away from the end 24 of the piston 12 in a sliding movement while the piston 12 is held in place.

Figure 3:
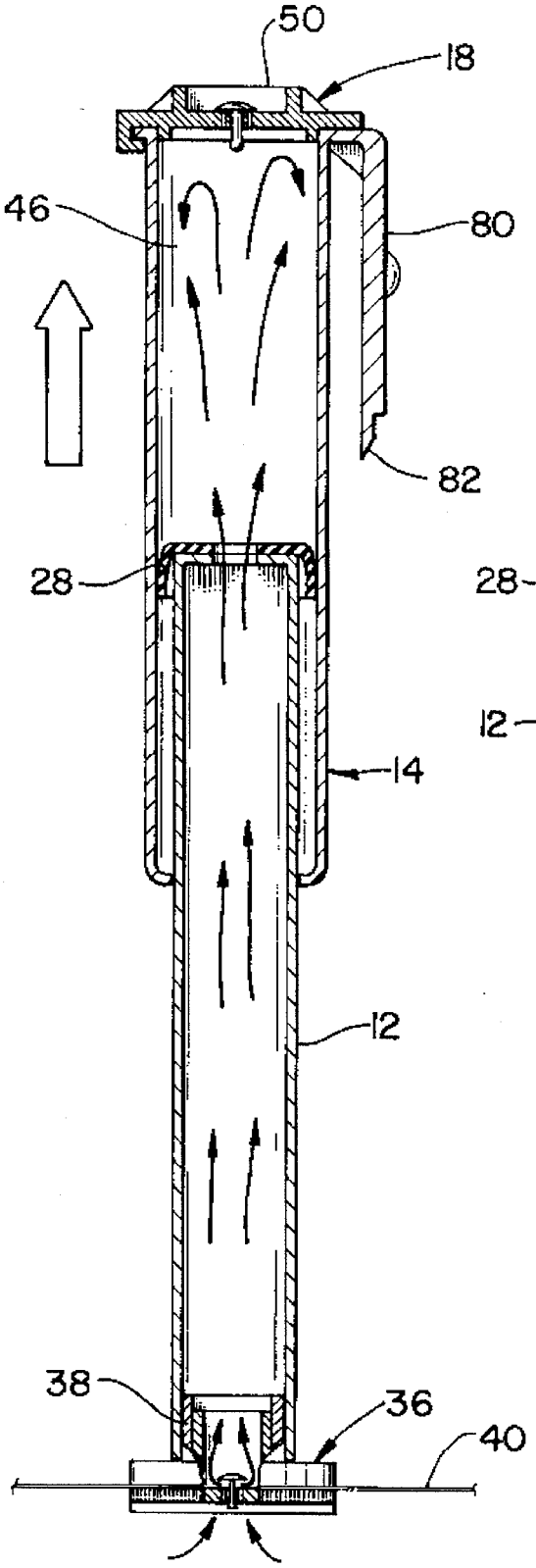
FIG. 3 is a cross-section similar to that of FIG. 2 but depicting the vacuum pump in a second mode of operation.

The piston ring 28 of the piston 12 seals tightly against the inside surface 32 of the housing 14. As the housing 14 is moved away from the end 24 of the piston 12, a vacuum space 46 is created between the piston ring 28 and the end 18 of the housing 14 (FIG. 3). A vacuum is created by this expanding sealed volume, and draws air from the container through the valve 36. The one-way valve 36 prevents the return of air into the container.

Figure 4:
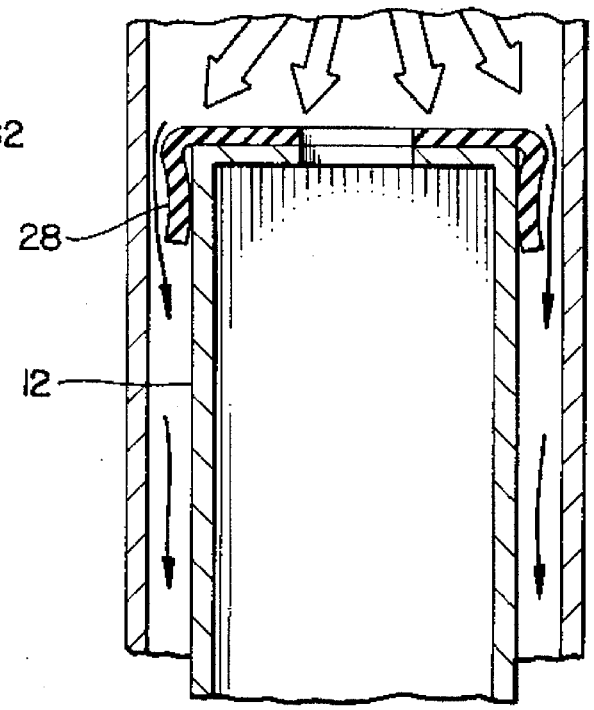
FIG. 4 is a cross-section depicting the flow of air past a piston ring according to the invention.

The housing 14 can be returned to the initial position relative to the piston 12 by pushing downwardly on the housing 14. Air pressure will be created by the contracting volume 46 and will force the air past the piston ring 28 (arrows in FIG. 4). The piston ring 28 is angled away from the contracting volume 46 such that the increasing pressure in that volume will flex the ring inwardly towards the sides of the piston 12 to permit the flow of air past the piston ring 28. The pumping process is repeated until substantially all of the air, or the desired amount of air, has been removed from the container.

Figure 5:
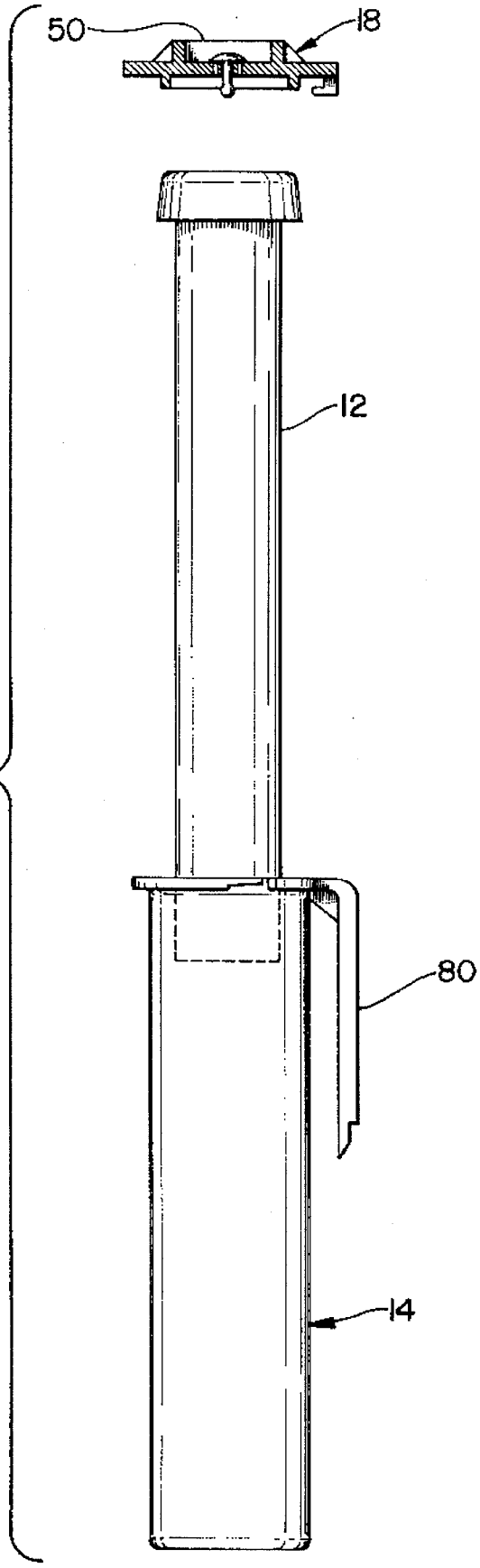
FIG. 5 is an exploded side elevation, showing a cap in cross-section depicting the assembly of one embodiment of a vacuum pump according to the invention.
Figure 7:
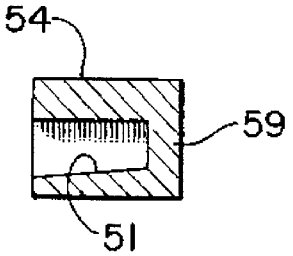
FIG. 7 is a cross-section taken along line 7—7 in FIG. 6.
Figure 8:
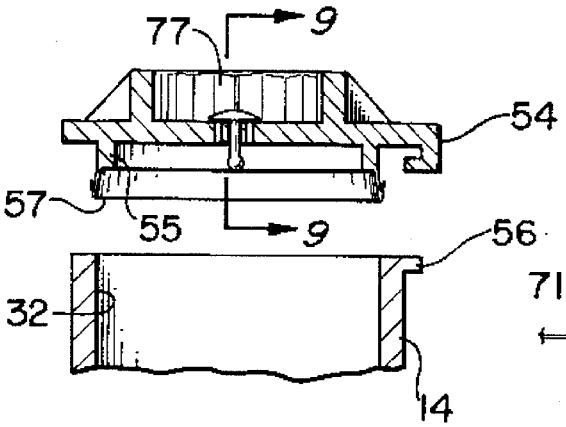
FIG. 8 is an exploded cross-section depicting attachment of the cap to the housing.

A detachable cap 50 can be provided to close the end 18 of the housing 14 (FIG. 5). The cap 50 also permits the insertion of the piston 12 into the housing 14 during the manufacturing process. The cap 50 can be secured to the housing 14 by any suitable structure, such as the locking tab structure shown in FIGS. 6–8. The cap 50 is preferably removable to permit further use of the cap, to be described below. Alternatively, the cap 50 can be secured in place by threads, welds, adhesives and the like. A one way valve 52 can be provided in either the end 18 or cap 50 to help to release air under pressure from the contracting volume 46 as the housing 14 is moved back to the initial position over the piston 12.

The cap 50 can have sealing tabs 54 which cooperate with housing tabs 56 on the housing 14 to secure the cap 50 in place. The sealing tabs 54 depend downwardly from an outwardly extending top flange portion of the cap 50. The housing tabs 56 are provided on a exterior surface of the housing 14 to receive the sealing tabs 54 when the cap 50 is turned, to firmly lock the cap 50 in place on the housing 14. Each of the sealing tabs 54 can have an inclined surface 51 and a back wall 59 to tightly lock the cap 50 in place. The cap 50 is preferably dimensioned such that a surface 55 fits partially within the housing 14 and a sealing flange portion 57 abuts the interior surface 32 of the housing 14 (FIG. 8) to help to prevent the leakage of air past the cap 50. Preferably, the tab 56 is a continuous ring around the circumference of the housing 14 for mating engagement with a annular receptacle in the cap 50. Other suitable connecting structure can alternatively be used.

Figure 9:
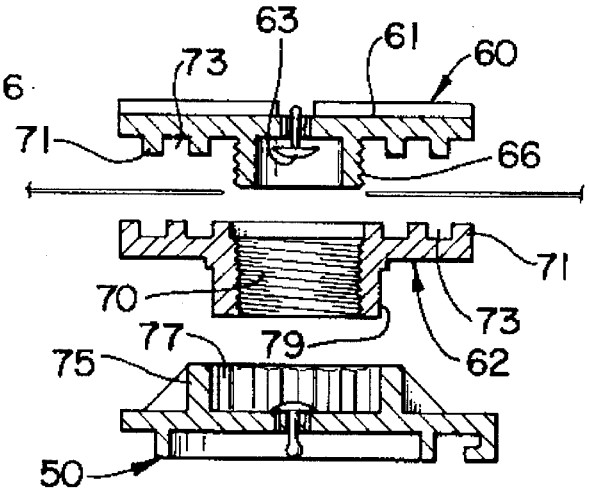
FIG. 9 is an exploded cross-section of a valve and cap according to the invention as the cap is used to install the valve in the flexible wall of a container.

The valve 36 can be of any suitable construction, so long as it contains a single direction valve system. The particular construction of the valve may change depending on the type of container with which the valve is used, such as flexible wall, rigid wall, or removable closure containers. The valve permits the withdrawal of air from the container. Also, the valve can permit the escape of air under pressure within the container, as can occur during cooking when air sealed in the container is raised to an elevated temperature. In an embodiment currently preferred for flexible wall containers, a valve 60 has a valve housing comprised of attachable sections 61 and 62 (FIG. 9). A central opening in the valve housing is provided for the passage of air. A one-way valve 63 preferably closes the opening until a sufficient pressure differential is created to open the valve 63. A currently preferred valve construction is that shown in Applicant's co-pending application Serial No. 08/199,642, filed Feb. 22, 1994, the disclosure of which is incorporated fully by reference.

The valve 60 is typically positioned on the flexible wall 40 by placing the interior unit 61 of the valve housing against an inside surface of the flexible wall 40, and the exterior unit 62 of the valve housing against an exterior surface of the flexible wall. The two units are mated together by suitable fastening structure. One such suitable fastening structure is a threaded central core 66 on the interior valve unit 61, and a cooperatively threaded central core 70 on the exterior valve unit 62. The cooperating male and female threads allow the two sections to be mated together (FIG. 10) with the flexible wall 14 extending between the two sections to form a substantially hermetic seal of the opening in the wall through which the valve is positioned. Each of the units 61 and 62 has cooperating male ridges 71 and female valleys 73 which tightly engage the flexible wall 14 when the units are threaded together.

Figure 6:
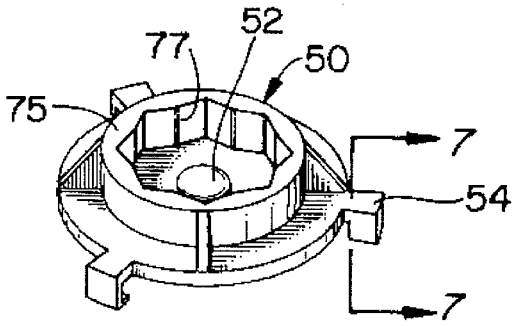
FIG. 6 is a bottom plan view of a cap for a vacuum pump according to the invention.
Figure 10:
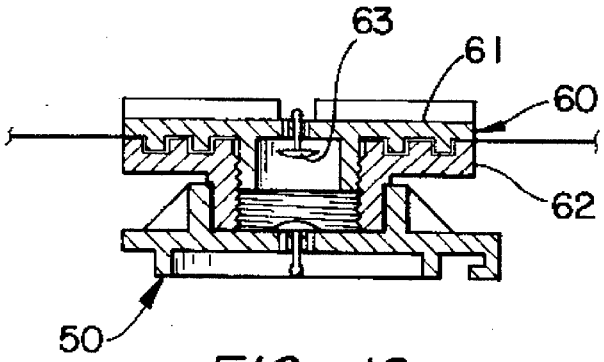
FIG. 10 is a cross-section of a valve assembly as installed in the flexible wall of a container.

The valve units 61 and 62 can be difficult for some users to firmly grasp when fastening them together. The cap 50 can be provided with a wrench top to permit the use of the cap 50 as a tool to turn the valve units 60 and 62. The cap 50 can have a wrench portion 75 with interior lugs 77 (FIG. 6). The lugs 77 cooperate with similar lugs 79 that are provided on a perimeter surface of the exterior unit 62 (FIG. 9). The larger diameter cap 50 can then be used to turn the unit and thread the valve units 61 and 62 together (FIG. 10). The threads of the valve and the sealing tabs 54 and housing tabs 56 preferably cooperate such that, if the wrench portion 75 is used while the cap 50 remains on the housing 14, the tightening of the valve units 61 and 62 will also tighten the cap 50.

The flexible wall 14 must be perforated in order to permit the withdrawal of air through the valve 60. According to the invention, the vacuum pump 10 is provided with a perforator to pierce an opening in the flexible wall 14 through which the valve 36 can be positioned and air can be withdrawn. The perforator 80 can be of any suitable design, but preferably is formed by a projection positioned on the exterior surface of the housing 14. The perforator 80 has a pointed end 82 which can be thrust into the flexible wall to form the opening. Preferably, the cap 50 can be formed to provide a cutaway along its circumference to receive a upper portion of the perforator 80 in a manner to anchor the cap from rotating. In this way, the cap can be used to wrench the valve while remaining on the pump housing.

The vacuum pump of the invention can be formed from any suitable materials, including metals, alloys, and plastics. The invention is especially well suited for production molding with plastics, since there are relatively few parts. The piston 12 and piston ring 28 can be molded as a single piece, as can the housing 14 and perforator 80.

The invention provides an efficient, easily manufactured pump which is easy to use and will create a negative vacuum of greater than 15 inches of mercury. The pump of the invention has only three parts, and assembly is quick and cost effective. Further, the invention is easy to use since it will both perforate the bag, and can be used by firmly grasping the pump housing 14 and pulling it from the piston 12.

This invention can be embodied in other specific forms without departing from the spirit or essential attributes thereof. Reference should be had to the following claims, rather than to the foregoing specification, as indicating the scope of the invention.

I claim:

1. A vacuum pump for removing air from containers through a valve, comprising:

an exterior pump housing comprising an elongated conduit, said conduit being closed to one end and opened at the other end;

a pump piston comprising an elongated conduit open at each end, said pump piston being slidably mounted within said pump housing and protruding from said open end of said housing, said piston having an inside end within said housing and an outside end protruding from said housing, and having substantially at said inside end an outwardly extending piston ring for sealing against an interior surface of the housing so as to prevent outside air from flowing into the space between the closed end of the housing and said piston ring, and to permit the outward flow of air from said space wherein said piston ring comprises a circular flange angled radially outwardly from said piston and toward said open end of said housing, said flange being flexed against said interior surface of said housing.

2. The vacuum pump of claim 1, wherein said piston ring is formed integrally with said piston.

3. The vacuum pump of claim 1, wherein said closed end of said housing comprises a detachable cap.

4. The vacuum pump of claim 3, wherein said detachable cap comprises wrench structure for cooperating with corresponding structure on a valve housing for installing the valve in a container.

5. The vacuum pump of claim 1, further comprising structure for penetrating a flexible wall.

6. The vacuum pump of claim 5, wherein said penetrating structure comprises an elongated member fixed at one end to said housing and free at an opposite end, whereby said free end can be thrust into flexible wall material to create an opening in said flexible wall for a valve.

7. The vacuum pump of claim 1, wherein said outside end of said piston is shaped to mate with a corresponding portion of a valve housing to substantially seal the piston to the valve housing.

8. The vacuum pump of claim 7, wherein at least one of an interior surface of said outside end of said piston and a perimeter portion of a valve housing comprises a taper whereby, when said piston is placed over and mated to a valve housing, said taper will cause the piston to seal tightly against the valve housing.

9. The vacuum pump of claim 7, further comprising a valve seat on an interior portion of said outside end of said piston, said valve seat being shaped to mate with a portion of said valve housing to seal said piston against said valve housing.

10. A system for removing air from containers, comprising:

a valve comprising a valve housing extending through an opening in a portion of said container;

a pump comprising an exterior pump housing comprising an elongated conduit, said conduit being closed at one end and open at the other end; and a pump piston comprising an elongated conduit open at each end, said pump piston being slidably mounted within said pump housing and protruding from said open end of said housing, said piston having an inside end within said housing and an outside end protruding from said housing, and having substantially at said inside end an outwardly extending piston ring for sealing against an interior surface of the housing so as to prevent outside air from flowing into the space between the closed end of the housing and said piston ring, and to permit the outward flow of air from said space, said outside end of said piston being shaped to mate with a portion of said housing of said valve to permit the withdrawal of gas from said container under a vacuum created by said pump.

11. The system of claim 10, wherein said piston ring comprises a circular flange angled radially outwardly from said piston and toward said open end of said housing, said flange being flexed against said interior surface of said housing.

12. The system of claim 11, wherein said piston ring is formed integrally with said piston.

13. The system of claim 12, wherein said closed end of said housing comprises a detachable cap.

14. The system of claim 13, wherein said detachable cap comprises wrench structure for engaging corresponding structure on said valve housing for installing the valve in said container.

15. The system of claim 10, wherein said container comprises a flexible wall portion, and said pump further comprises structure for penetrating said flexible wall portion of said container.

16. The system of claim 15, wherein said penetrating structure comprises an elongated member fixed at one end to said housing and free at an opposite end, whereby said free end can be thrust into said flexible wall to create an opening in said flexible wall for the insertion of said valve.

17. The system of claim 10, wherein said outside end of said piston is shaped to mate with a corresponding portion of a valve housing to substantially seal the piston to the valve housing.

18. The system of claim 17, wherein at least one of an interior surface of said outside end of said piston and a perimeter portion of said valve housing comprises a taper, whereby when said piston is placed over and mated to said valve housing said taper will cause the piston to seal tightly against the valve housing.

19. The system of claim 17, further comprising a valve seat on an interior portion of said outside end of said piston, said valve seat being shaped to mate with a portion of said valve housing to seal said piston against said valve housing.

20. The system of claim 10, wherein the valve housing includes an air valve, said valve housing providing a lower unit and an upper unit, each unit having a central opening, each unit having an inner surface and an outer surface, each inner surface containing male and female components, said valve attached within said lower unit, said lower unit inner surface being capable of mounting on the interior wall surface wherein said valve encloses an opening in said wall surface and the lower unit central opening, and said male and female components engaging said interior wall, said upper unit inner surface being capable of mounting on said exterior wall surface wherein its male and female components engage said mating female and male components to compress the engaged wall area therebetween and seal said air valve within said upper and lower units, whereby air within said sealed container is removed through said central openings with said pump.

21. The system of claim 20, wherein a plurality of radial ridges extend from the central opening on the lower unit outer surface.

22. The system of claim 10, wherein the valve housing includes an air valve, said valve housing providing a lower unit and an upper unit, each unit having a central opening, each unit having an inner surface and an outer surface, each inner surface containing at least two of male and female components, said valve attached within said lower unit, said lower unit inner surface being capable of mounting on the interior wall surface wherein said valve encloses an opening in said wall surface and the lower unit central opening, and said at least two of male and female components engaging said interior wall, said upper unit inner surface being capable of mounting on said exterior wall surface wherein its at least two of male and female components engage said mating at least two of female and male components, thereby forming a plurality of sets of interengaging sealing members to compress the engaged wall area therebetween and seal said air valve within said upper and lower units, whereby air within said sealed container is removed through said central openings with an said pump.

23. The air removal device according to claim 22, wherein said plurality of sets of interengaging sealing members are annularly and concentrically arranged around said central openings.

24. A method for removing air from containers, comprising the steps of:

providing a valve comprising a valve housing in an opening in said container;

providing a vacuum pump having an exterior pump housing comprising an elongated conduit, said conduit being closed at one end and open at the other end, and providing a pump piston comprising an elongated conduit open at each end, said pump piston being slidably mounted within said housing and protruding from said open end of said housing, said piston having an inside end within said housing and an outside end protruding from said housing, and having substantially at said inside end an outwardly extending piston ring for sealing against an interior surface of the housing so as to prevent outside air from flowing into the space between the closed end of the housing and said piston ring, and to permit the outward flow of air from said space, said outside end of said piston being shaped to mate with a portion of said housing of said valve;

mating said outside end of said piston with a portion of said valve housing so as to form a substantially airtight seal with said valve housing;

moving said housing relative to said piston so as to create a vacuum to draw air out of said container and through said valve.

* * * * *